US008701776B2

(12) United States Patent
Smith et al.

(10) Patent No.: US 8,701,776 B2
(45) Date of Patent: Apr. 22, 2014

(54) DOWNHOLE ACTUATING APPARATUS

(71) Applicant: Petrowell Limited, Aberdeen (GB)

(72) Inventors: Colin Smith, Aberdeen (GB); Daniel George Purkis, Aberdeen (GB)

(73) Assignee: Petrowell Limited, Aberdeenshire (GB)

( * ) Notice: Subject to any disclaimer, the term of this patent is extended or adjusted under 35 U.S.C. 154(b) by 0 days.

(21) Appl. No.: 13/627,705

(22) Filed: Sep. 26, 2012

(65) Prior Publication Data

US 2013/0025868 A1 Jan. 31, 2013

Related U.S. Application Data

(63) Continuation of application No. PCT/GB2011/050467, filed on Mar. 10, 2011.

(30) Foreign Application Priority Data

Mar. 26, 2010 (GB) ..... 1005133.2

(51) Int. Cl.
*E21B 34/06* (2006.01)

(52) U.S. Cl.
USPC ..... 166/318; 166/373; 166/386

(58) Field of Classification Search
USPC ..... 166/318, 311, 312, 305.1, 373, 386, 166/331
See application file for complete search history.

(56) References Cited

U.S. PATENT DOCUMENTS

| | | | |
|---|---|---|---|
| 3,211,226 | A | 10/1965 | Myers et al. |
| 7,322,417 | B2 | 1/2008 | Rytlewski et al. |
| 7,357,198 | B2 | 4/2008 | Mcgarian et al. |
| 7,377,321 | B2 | 5/2008 | Rytlewski |
| 7,387,165 | B2 | 6/2008 | Lopez de Cardenas et al. |
| 7,416,029 | B2 | 8/2008 | Telfer et al. |
| 7,581,596 | B2 | 9/2009 | Reimert et al. |
| 7,661,478 | B2 | 2/2010 | Palmer et al. |
| 7,766,084 | B2 | 8/2010 | Churchill |
| 2002/0074128 | A1 | 6/2002 | Allamon et al. |
| 2003/0136563 | A1 | 7/2003 | Allamon et al. |
| 2004/0118564 | A1 | 6/2004 | Themig et al. |
| 2007/0102163 | A1 | 5/2007 | Heath et al. |

(Continued)

FOREIGN PATENT DOCUMENTS

| | | | |
|---|---|---|---|
| GB | 2314106 | A | 12/1997 |
| GB | 2377234 | A | 1/2003 |
| WO | 2011117601 | A2 | 9/2011 |
| WO | 2011117602 | A2 | 9/2011 |

OTHER PUBLICATIONS

Written Opinion of the International Searching Authority received in corresponding PCT Application No. PCT/GB2011/050467.

(Continued)

*Primary Examiner* — Giovanna Wright

(74) *Attorney, Agent, or Firm* — Wong, Cabello, Lutsch, Rutherford & Brucculeri LLP

(57) ABSTRACT

A mechanical counting device for actuating a plurality of output devices, the device comprising: linear indexing means adapted to count a plurality of actuating signals and to cause actuation of the output devices when a predetermined number of actuating signals for each output device has been received, wherein the mechanical counting device is adapted to cause actuation of a particular output device when a different predetermined number of actuating signals has been received such that the output devices are sequentially actuable.

56 Claims, 7 Drawing Sheets

(56) References Cited

U.S. PATENT DOCUMENTS

| | | | | |
|---|---|---|---|---|
| 2009/0308588 | A1 | 12/2009 | Howell et al. | |
| 2010/0282338 | A1 | 11/2010 | Gerrard et al. | |
| 2010/0294514 | A1 | 11/2010 | Crow et al. | |
| 2010/0294515 | A1 | 11/2010 | Xu | |
| 2011/0067888 | A1 | 3/2011 | Mireles | |
| 2011/0203800 | A1* | 8/2011 | Tinker et al. | 166/318 |
| 2011/0240301 | A1 | 10/2011 | Robinson et al. | |
| 2011/0240311 | A1 | 10/2011 | Robison et al. | |
| 2011/0278017 | A1* | 11/2011 | Themig et al. | 166/373 |
| 2012/0048556 | A1 | 3/2012 | O'Connell et al. | |

OTHER PUBLICATIONS

Written Opinion of the International Searching Authority received in corresponding PCT Application No. PCT/GB2011/050469.

Office Action in U.S. Appl. No. 13/627,705, dated Feb. 13, 2013.

* cited by examiner

DOWNHOLE ACTUATING APPARATUS

CROSS-REFERENCE TO RELATED APPLICATIONS

This application is a continuation of PCT/GB2011/050467, filed Mar. 10, 2011, which claims priority to United Kingdom Patent Application No. GB1005133.2, filed on Mar. 26, 2010, the contents of each one incorporated herein by reference.

FIELD OF INVENTION

The present invention relates to mechanical devices for counting input signals. In particular, the invention relates to mechanical devices for counting input signals to actuate downhole tools in a sequential manner.

BACKGROUND TO INVENTION

There are many situations in which downhole tools must be selectively actuated. However, communicating with the tools to cause actuation can be difficult in the downhole environment. Systems such as RFID systems exist but these are complex, expensive and prone to failure. Indeed, any form of electrical, electronic or magnetic device is often not robust enough to withstand the harsh downhole environment.

During hydraulic fracturing of a multiple zone well, a series of tools, or clusters of tools, are provided at each zone, and each downhole tool needs to be actuated and fluid is diverted to flow outwards to fracture the well. The actuation must be performed in a sequential manner to allow the borehole to be progressively fractured along the length of the bore, without leaking fracture fluid out through previously fractured regions.

Due to the expense and frequent failure of electronic or electrical devices, the most common approach to tool actuation is still fully mechanical. Balls of ever increasing size are dropped down a tubular positioned within the well bore. The tools are configured so that the first dropped ball, which has the smallest diameter, passes though the first and intermediate tools, which have a ball seat (hereinafter referred to as a valve seat) larger than the ball, until it reaches the furthest away tool in the well. This furthest away tool is configured to have a valve seat smaller than the first dropped ball so that the ball seats at the tool to block the main passage and cause transverse ports to open thus diverting the fluid flow. Subsequently dropped balls are of increasing size so that they too pass through the nearest tools but seat at further away tools which have a suitably sized valve seat. This is continued until all the tools have been actuated in the order of furthest away to nearest.

Therefore, this approach does not involve counting the dropped balls. Balls which are too small for a particular tool are simply not registered. However, this approach has a number of disadvantages. The number of tools with varying valve seats that can be used is limited in practice because there must be a significant difference in the size of the seat (and therefore the ball) so that the ball does not inadvertently actuate previous tools. Also, the valve seats act as restrictions to flow through the tubular which are always undesirable. The smaller the seat the greater the restriction.

It is desirable to provide an apparatus which allows: actuation of a large number of downhole tools; and/or downhole tools with the same size of valve seat; and/or valve seats with the largest possible diameter.

SUMMARY OF INVENTION

According to a first aspect of the present invention there is provided a mechanical counting device locatable at each of a plurality of downhole tools arranged within and along a well bore, each tool having a main bore corresponding to the tubular positioned in the well bore, and each tool being actuatable to open one or more fluid ports which are transverse to the main bore, the mechanical counting device comprising:

linear indexing means adapted to cause the mechanical counting device to linearly progress along the main bore by a predetermined distance in response to receiving an actuating signal until reaching an actuation site of the tool whereupon the tool is actuated, wherein the mechanical counting device is locatable at a plurality of different predetermined positions within the main bore such that the downhole tools are sequentially actuatable.

The mechanical counting device may be adapted to engage with one of a plurality of longitudinal recesses provided along the main bore.

The mechanical counting device may be adapted to linearly progress along the main bore by the predetermined distance in response to an object, such as a ball, dropped within the tubular positioned within the well bore, which thus provides the actuating signal.

The mechanical counting device may be adapted, upon reaching the actuation site, to cause the dropped object to stop at the tool, thus blocking the main bore at the tool.

The mechanical counting device may be adapted to linearly progress in a number of discrete steps to the actuation site. Each discrete step may correspond to the mechanical counting device moving from one longitudinal recess to the adjacent longitudinal recess.

The mechanical counting device may comprise a collet member having a number of fingers and a protrusion provided at the end of each finger. Each finger may be flexible. The collet member may comprise a tubular member having a bore which is sized such that the dropped object may pass through the tubular member. Each finger may be movable between a first position in which the protrusion is outwith the bore of the tubular member and a second position in which the protrusion is within the bore of the tubular member and contactable by the dropped object. Each finger may be bendable between the first and second positions.

The collet member may be locatable within the main bore such that the protrusion of one or more fingers is engaged with a recess when the finger is at the first position and not engaged with a recess when the finger is at the second position.

The collet member may comprise a first set of fingers and a second set of fingers which is longitudinally spaced from the first set. The collet member and the recesses may be configured such that, when the fingers of the first set are engaged with a recess, the fingers of the second set are not engaged with a recess. The collet member and the recesses may be configured such that, when the fingers of the second set are engaged with a recess, the fingers of the first set are not engaged with a recess.

The collet member may be adapted such that the dropped object passing through the main bore contacts the protrusion of the one or more fingers which are at the second position such that the collet member is linearly moved in the direction of travel of the dropped object. The collet member may be linearly moved until the protrusion engages with the next recess. The collet member may be adapted such that engagement with the next recess allows the dropped object to continue past the set of fingers of which the protrusion has engaged with the next recess.

The collet member may be adapted such that the linear movement causes the protrusion of the one or more fingers which are at the first position to disengage from the recess and move to the second position. The collet member may be linearly moved by the impact force from the dropped object and/or by fluid pressure upstream of, and acting on, the dropped object.

In this manner, the collet member is linearly movable in a stepwise sequence, moving one recess every time an object is dropped.

The mechanical counting device may be movable towards a sleeve member provided within the main bore and adapted to block the transverse ports. The collet member may be adapted to contact and act upon the sleeve member upon reaching the actuation site to move the sleeve member and cause fluid communication between the main bore and the transverse ports.

In this manner, the collet member is linearly movable one recess at a time towards the actuation site whereupon it causes moving of the sleeve member to open the transverse ports. The main bore of each tool can be provided with a large number of recesses. For a particular tool, the collet member can be located a particular number of recesses from the actuation site. The number of recesses can be arranged to vary for each tool depending on its proximity to the surface. For instance, the tool furthest from the surface could have the least number of recesses, such as only one, while the tool nearest the surface could have the greatest number of recesses, such as fifty if there is a total of fifty tools within the well bore. The tools will therefore sequentially actuate in the order of furthest away to nearest.

BRIEF DESCRIPTION OF DRAWINGS

Embodiments of the present invention will now be described, by way of example only, with reference to the accompanying drawings in which.

DETAILED DESCRIPTION OF DRAWINGS

Figure 1:
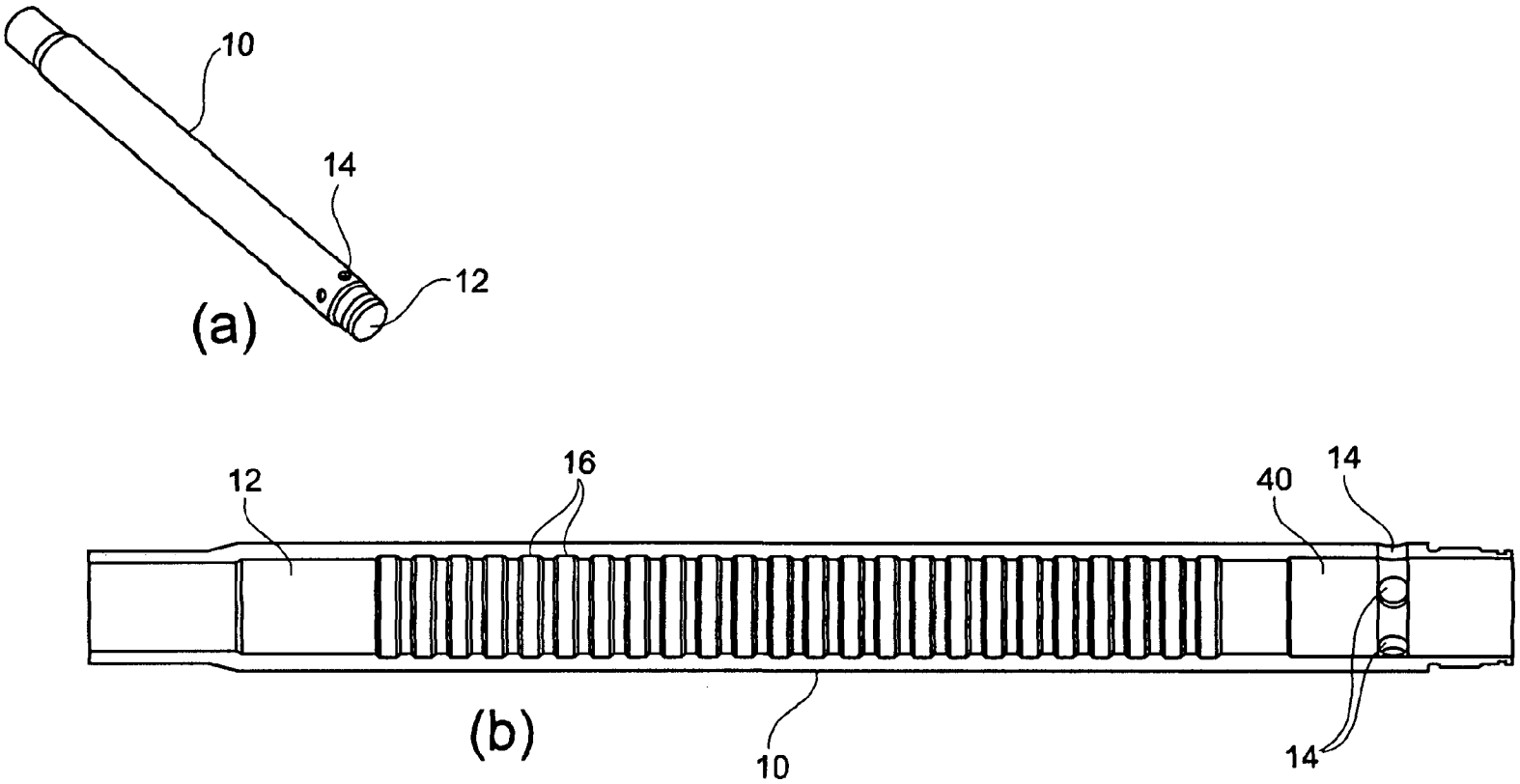
FIG. 1 is a (a) perspective view and a (b) sectional side view of a housing of a tool (shown in FIG. 3) of a downhole actuating apparatus.

FIG. 1 shows a downhole tool 10 of a downhole actuating apparatus. The apparatus comprises many of these downhole tools 10, such as fifty, which can be secured to a tubular and sequentially arranged along a well bore. As utilized throughout this specification, the term "tubular" refers to any generally tubular conduit for transporting fluid, particularly oil, gas and/or water, in and/or from a subterranean well. A "tubular" as deployed in a subterranean well, may be formed from individual, discrete lengths of generally tubular conduit usually secured together by means of collars to form, for example a tubing string, drill string, casing string, liner, etc., which is positioned in a subterranean well and utilized, at least in part, to transport fluids. The tubular may have a bore of a generally uniform diameter throughout the length thereof or may have two or more sections having bores of different diameters. For example, the tubular may be comprised of a casing string positioned within the well bore, extending at one end thereof from the well head, either surface or subsea, and connected at or near the other end thereof to a tubing string or liner having a bore that is smaller than that through the casing string. As another example, the tubular may be comprised of a tubing string positioned within the well bore, extending at one end thereof from the well head, either surface or subsea, and connected at or near the other end thereof to a casing string or liner having a bore that is larger than that through the tubing string. Environments other than a subterranean well in which tubulars may be used in accordance with the present invention, include, but are not limited to, pipelines and sewer lines.

In this embodiment, the tools 10 are provided for the purpose of well fracturing. Each tool 10 has a main bore 12 which in use is coaxial with the tubular positioned within a well bore and a number of transverse fluid ports 14. The main bore 12 of the tool 10 defines a number of annular grooves or recesses 16, the recesses 16 each being equally and longitudinally spaced apart by a predetermined spacing. The number of recesses 16 can be configured to be the same as the total number of tools 10.

Figure 2:
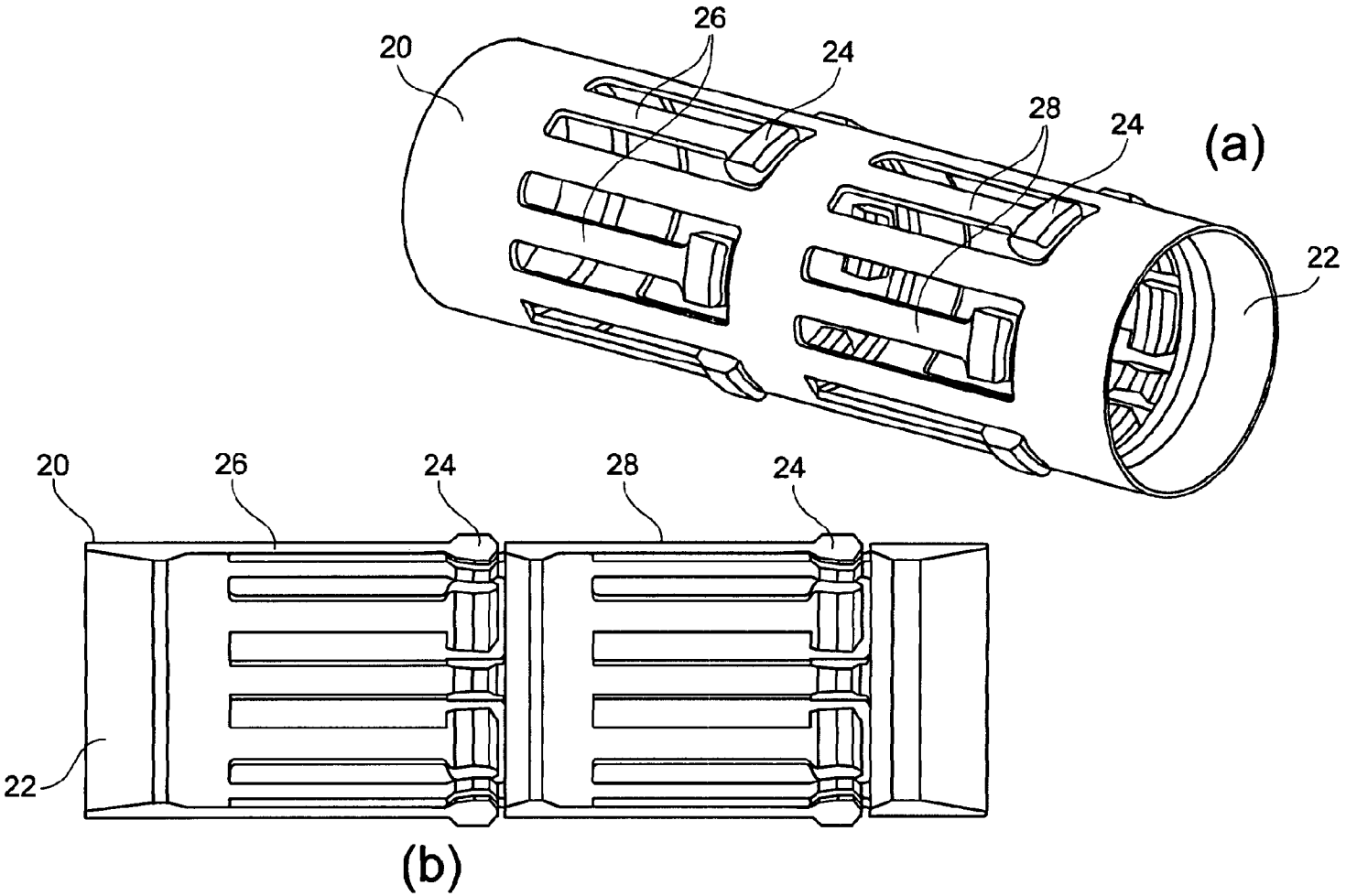
FIG. 2 is a (a) perspective view and a (b) sectional side view of a collet of a downhole actuating apparatus.

Inserted within the main bore 12 of each tool 10 is a collet 20 as shown in FIGS. 3 to 7. Referring to FIG. 2, the collet 20 is tubular and has a bore 22 which is coaxial with the main bore 12 when the collet 20 is inserted within the main bore 12. Each collet 20 has two sets of flexible fingers and a protrusion 24 is provided at the end of each finger. Each finger is bendable, when a transverse force is applied to the protrusion 24, between a first position in which the protrusion 24 is outwith the bore 22 of the collet 20 and a second position in which the protrusion 24 is within the bore 22. When the collet 20 is inserted within the main bore 12, each protrusion 24 is at the first position when engaged with a recess 16 and at the second position when the protrusion 24 is not engaged with a recess 16.

The first set of fingers 26 and the second set of fingers 28 are longitudinally spaced apart by a predetermined distance. This distance is configured so that, when the fingers 26 of the first set are engaged with a recess 16, the fingers 28 of the second set are not engaged with a recess 16, rather they are between two adjacent recesses 16 and so at the second position.

The collet 20 is adapted such that a dropped object such as a ball 30 can pass through the main bore 12 but it will contact the protrusion 24 of any fingers which are at the second position. FIGS. 4 to 7 show a ball 30, dropped from the surface and travelling in direction 100, passing through the collet 20.

Figure 4:
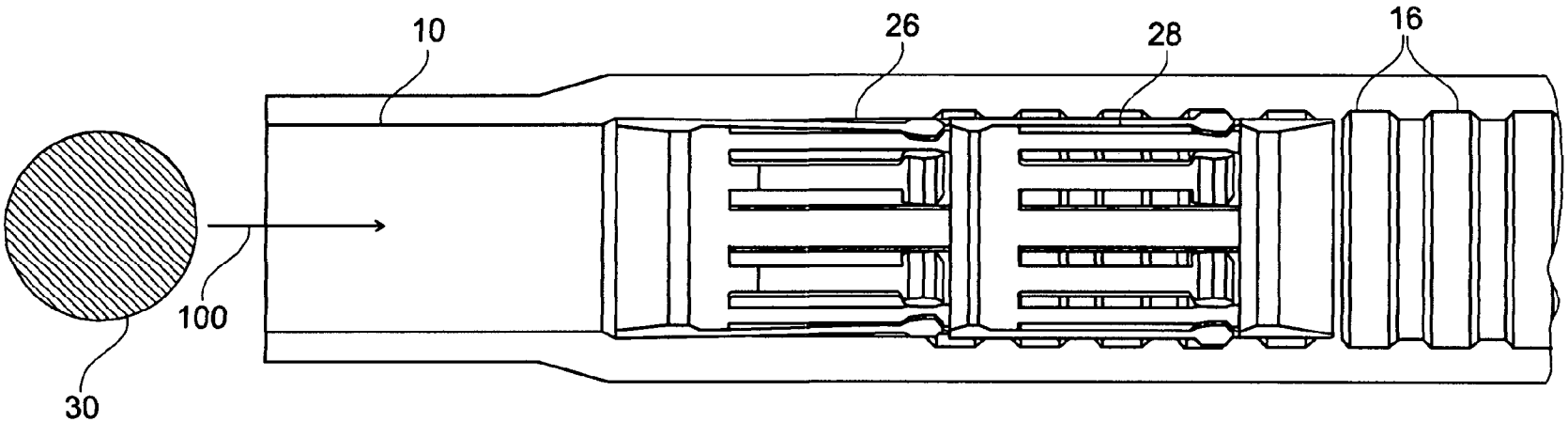
FIG. 4 is a detailed sectional side view of a portion of the tool of FIG. 1 with a ball approaching the tool.

As shown in FIG. 4, each protrusion 24 of the second set of fingers 28 is engaged with a recess 16 and so are unbent and at the first position. However, the protrusions 24 of the first set of fingers 26 are engaged with a recess 16 and so are bent inwards to the second position. It should be noted that the collet 20 could be configured such that the first set of fingers 26 are at the first position and the second set of fingers 28 are at the second position.

Figure 5:
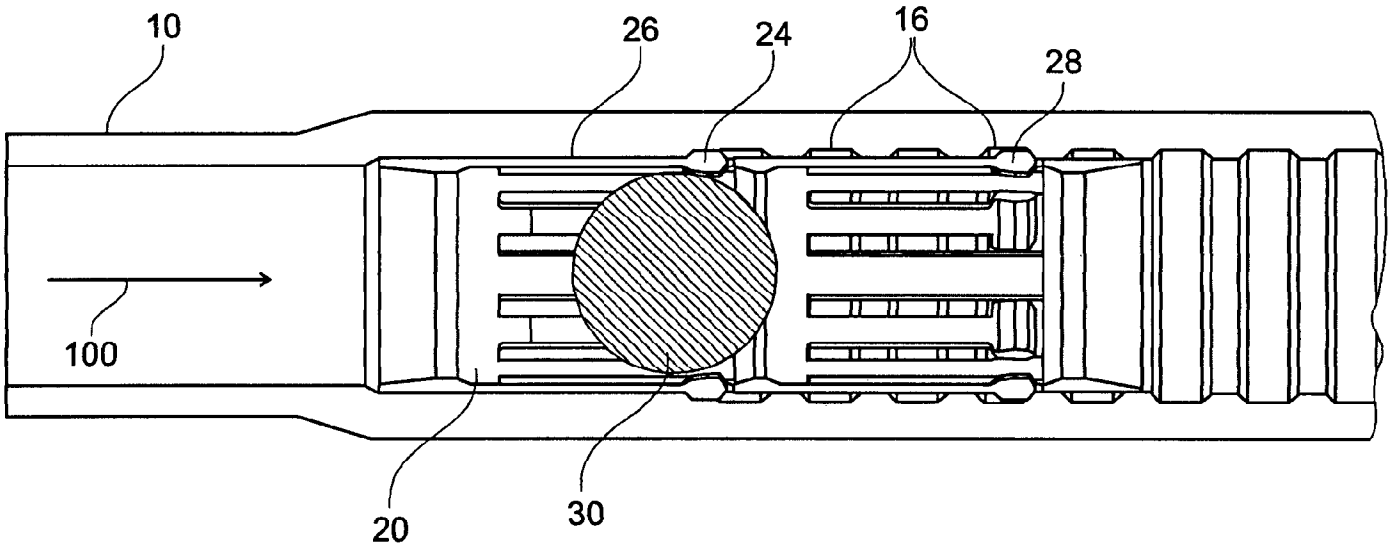
FIG. 5 is a detailed sectional side view of a portion of the tool of FIG. 1 with the ball landing at the first seat.

As shown in FIG. 5, the ball 30 contacts the protrusions 24 of the first set of fingers 26 since they are within the bore 22. One or both of the impact force from the ball 30 and fluid pressure upstream of the ball 30 then causes the collet 20 to be linearly moved in the travel direction 100. This causes the second set of fingers 28 to disengage from the recess 16 and linearly move to a location between this recess 16 and the next recess 16. These fingers 28 are now at the second position. At the same time, the first set of fingers 26 move forward to engage with the next recess 16 causing the fingers 26 to unbend to the first position. The protrusions 24 and recesses 16 are suitably profiled to allow the protrusion 24 to disengage from the recess 16 when a sufficient linear force is applied.

Figure 6:
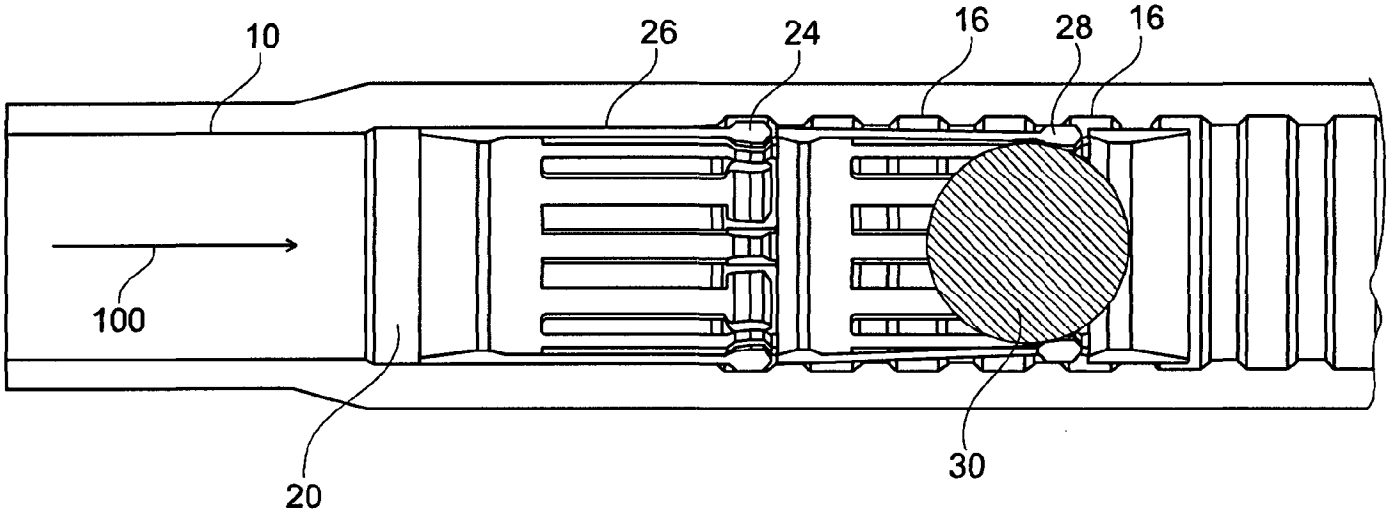
FIG. 6 is a detailed sectional side view of a portion of the tool of FIG. 1 with the ball landing at the second seat.

FIG. 6 shows the fingers in their new positions. Also, with the first set of fingers 26 at the first position, the ball 30 is free to continue its travel until it meets the second set of fingers 28. Since these are now at the second position, the ball 30 is stopped at this location.

Again, the impact force from the ball 30 and/or fluid pressure upstream of the ball 30 causes the collet 20 to be linearly moved in the travel direction 100. This causes the first set of fingers 26 to disengage from the recess 16 and linearly move to a location between this recess 16 and the next recess 16. These fingers 26 are now at the second position. At the same time, the second set of fingers 28 move forward to engage with the next recess 16 causing the fingers 28 to unbend to the first position.

Figure 7:
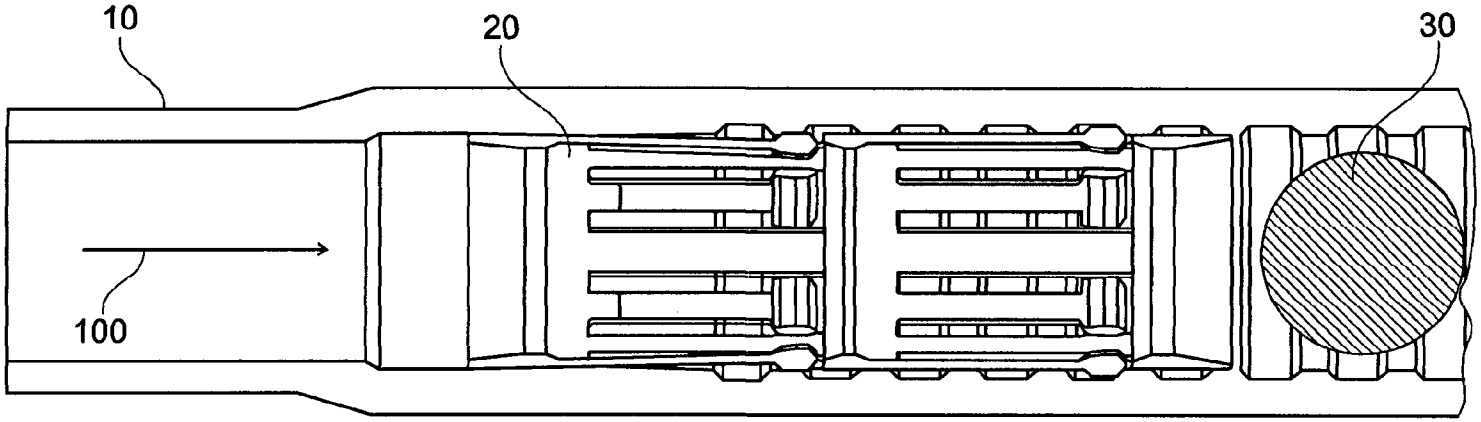
FIG. 7 is a detailed sectional side view of a portion of the tool of FIG. 1 with the ball released.

FIG. 7 shows the fingers in their new positions. It should be noted that these positions are the same as their original positions before the ball 30 approached the collet 20. With the second set of fingers 28 at the first position, the ball 30 is free to continue its travel along the well bore, exiting this tool 10. The ball 30 will continue to travel through a tubular to the next tool 10 where it will drive forward the collet 20 associated with the tool 10 and so on until the last tool is reached.

Therefore, the overall effect of the ball 30 passing through the tools 10 is that the associated collet 20 is linearly moved forward one recess 16. Any subsequently dropped balls 30 would have the same effect. The collet 20 is therefore linearly moved in a stepwise sequence, moving one recess 16 every time a ball 30 is dropped.

Figure 3:
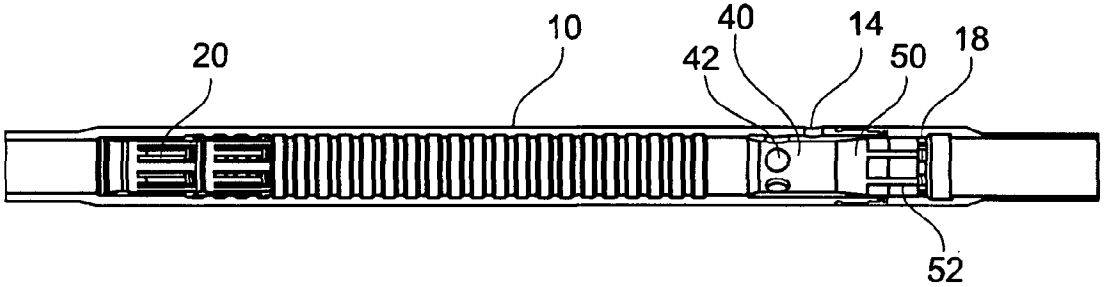
FIG. 3 is a sectional side view of a tool of a downhole actuating apparatus with a sleeve in the closed position.

Each tool 10 includes a sleeve 40, as shown in FIGS. 1 and 3. The sleeve 40 includes a number of apertures 42. In its normal position, the sleeve 40 is connected to the main bore 12 by a connecting member or shear pin and, at this position, the apertures 42 are longitudinally spaced from the transverse ports 14. Therefore, the sleeve 40 blocks the transverse ports 14 to fluid within the main bore 12. FIG. 2 shows this normal position with the transverse ports 14 blocked. Seals are provided to prevent leakage of fluid from the main bore 12 to the transverse ports 14.

As shown in FIG. 3, a second collet 50 is provided within the main bore 12 just downstream of the sleeve 40. With the sleeve 40 in its normal position, the protrusion of the fingers 52 of the second collet 50 are engaged with second recesses 18 provided at the main bore 12. Therefore, the second collet 50 is unaffected by any dropped balls 30 passing through the tool 10.

When a predetermined number of balls 30 have been dropped for the particular tool 10, the collet 20 will have been moved to reach and contact the sleeve 40 and this is termed the actuation site. Further linear movement of the collet 20 applies a longitudinal force on the sleeve 40 to linearly move the sleeve 40 when the force is great enough to cause shearing of the shear pin. This movement of the sleeve 40 causes alignment of the apertures 42 of the sleeve 40 and the transverse ports 14 so that there is fluid communication between the main bore 12 and the transverse ports 14. The movement also causes the sleeve 40 to act upon and linearly move the second collet 50 such that the protrusions of the fingers 52 of the second collet 50 disengage with second recesses 18. A dropped ball 30 will stop at these protrusions and block the main bore 12.

Therefore, the main bore 12 is now blocked and the transverse ports 14 are open. The tool 10 has been actuated and fluid travelling in the well bore in direction 100 will be diverted out of the tool 10 via the transverse ports 14.

The apparatus can be arranged so that the collet 20 is located within the main bore 12 of a particular tool 10 at a predetermined number of recesses 16 from the actuation site. The tools 10 can be arranged so that this predetermined number of recesses 16 varies for each tool 10 depending on its proximity to the surface. The tool 10 furthest from the surface can involve only one recess 16, while the tool 10 nearest the surface could have the greatest number of recesses 16, such as fifty. The tools 10 with a collet 20 which is a smaller number of recesses 16 from the sleeve 40 will actuate first. The tools 10 will therefore sequentially actuate in the order of furthest away to nearest.

Therefore, each tool 10 is provided with indexing means which is adapted to register receipt of an actuating signal (the dropped ball 30) and to cause actuation of the tool 10 when a predetermined number of actuating signals has been received. At least two of the tools 10 is actuated when a different predetermined number of actuating signals has been received and so the downhole tools 10 are sequentially actuatable.

Also, the predetermined number of recesses 16 for each tool 10 corresponds to the predetermined number of actuating signals. This may be an identically correspondence, or the predetermined number of recesses could equal, say, the predetermined number of actuating signals minus one. This would be the case if the collet 20 is moved, say, four recesses 16 to move the sleeve and a fifth ball 30 is used to block the main bore 12 (rather than the fourth ball 30 moving the sleeve before being caught by the second collet 50).

The present invention allows each tool 10 to have a valve seat of the same size and to have a main bore of the same size which is substantially equivalent to the bore through the tubular. Each ball 30 dropped is also the same size. It should also be noted that the mechanical counting device of the present invention is non-electrical, non-electronic and non-magnetic. Rather, it is a fully mechanical apparatus.

Figure 8:
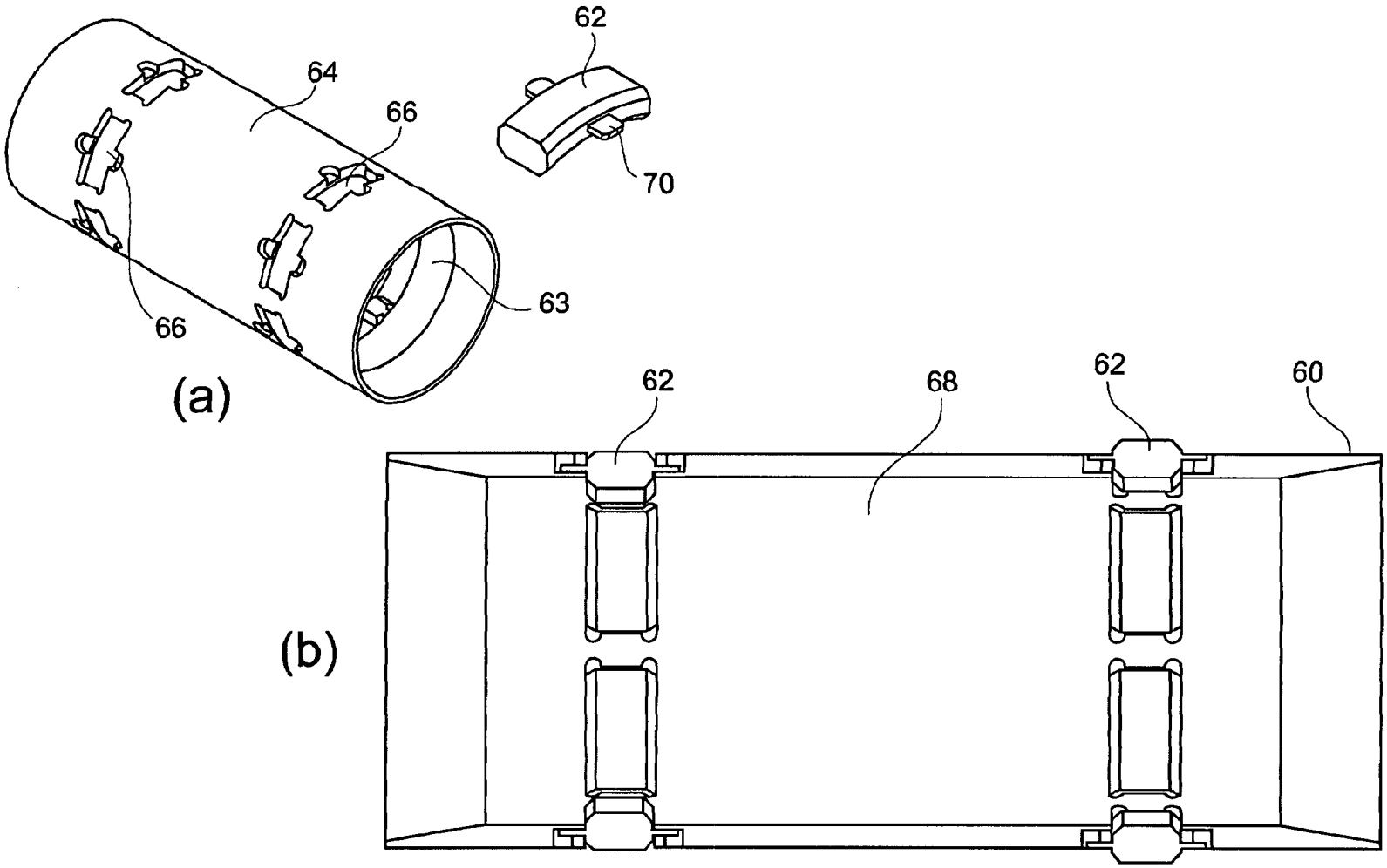
FIG. 8 is a (a) perspective view and a (b) sectional side view of a dog assembly.

FIG. 8 shows an alternative mechanical counting device which is a dog assembly 60 that may be used with the tool 10. In this embodiment, two sets of dogs 62 are provided, rather than the fingers of the collet 20. Each set of dogs 62 are equispaced around the tubular body 64 of the dog assembly 60. As before, the dogs 62 are engagable with recesses 16 of the tool 10.

Each dog 62 comprises a block of material, such as steel which is provided within an aperture 66 of the tubular body 84. Each dog 62 is thicker than the thickness of the tubular body 64 and is movable between a first position in which the under surface of the dog 62 is flush with the inner surface of the tubular body 64 (and so does not protrude into the bore 68 of the tubular body 64) and a second position in which the dog 62 protrudes into the bore 22. FIG. 8 (b) shows both positions. Each dog 62 includes two wings 70 to prevent the dog 62 from escaping the aperture 66 and falling into the bore 68.

A dropped ball 30 will contact the dogs 62 of the first set since they are within the bore 68. The dog assembly 60 will then be linearly moved in the travel direction 100 which causes the dogs 62 of the second set to disengage from the recess 16 and linearly move to the second position. At the same time, the dog 62 of the first set will move forward to the first position. The ball 30 is now free to continue forward until it meets the dog 62 of the second set since they are now at the second position.

The dog assembly 60 is then linearly moved as the ball 30 acts upon the dogs 62 of the second set. This causes the dogs 62 of the first set to disengage from the recess 16 and linearly move to the second position. At the same time, the dogs 62 of the second set move forward to engage with the next recess 16. The ball 30 is now free to continue its travel along the well bore, exiting this tool 10.

Whilst specific embodiments of the present invention have been described above, it will be appreciated that departures from the described embodiments may still fall within the scope of the present invention.

The invention claimed is:

1. A downhole actuating apparatus comprising:

a plurality of downhole tools arrangable within and along a well bore, wherein each tool defines a main bore and comprises:

an actuatable member; and an indexer provided within the main bore and adapted to register receipt of a plurality actuating signals to linearly progress in a corresponding number of discrete steps along the main bore towards the actuatable member to contact and act upon the actuatable member and cause actuation of the tool when a predetermined number of actuating signals has been received, wherein the indexer of at least two of the tools is adapted to cause actuation when a different predetermined number of actuating signals has been received such that the downhole tools are sequentially actuatable.

2. An apparatus as claimed in claim 1, wherein the predetermined number of actuating signals of each tool is configured to increase from the tool furthest from the surface to the tool nearest the surface when the tools are arranged along the well bore.

3. An apparatus as claimed in claim 1, wherein the indexer is adapted to register the presence of an object transported therethrough, which thus provides the actuating signal.

4. An apparatus as claimed in claim 3, wherein the indexer is adapted to register the number of objects transported therethrough, and wherein the tool is actuated when the presence of a predetermined number of objects has been registered.

5. An apparatus as claimed in claim 4, wherein the indexer is adapted, when the predetermined number of actuating signals has been received, to cause the object to stop at the tool.

6. An apparatus as claimed in claim 5, wherein each tool comprises a valve seat located within the main bore and the indexer is adapted to reduce the size of the valve seat so as to cause the object to stop at the tool.

7. The apparatus of claim 4, wherein the indexer is adapted, when the predetermined number of actuating signals has been received, to cause the object to stop at the tool and block the main bore.

8. An apparatus as claimed in claim 1, wherein each tool has a valve seat located within the main bore, each valve seat being of substantially the same size.

9. An apparatus as claimed in claim 1, wherein the indexer is a linear indexer.

10. An apparatus as claimed in claim 1, wherein the indexer comprises a movable device adapted to move in response to receiving an actuating signal.

11. An apparatus as claimed in claim 10, wherein the movable device is adapted to linearly progress along the main bore in response to receiving an actuating signal.

12. An apparatus as claimed in claim 11, wherein the movable device is adapted to linearly progress towards an actuation site and, upon reaching the actuation site, to cause the actuation of the tool.

13. An apparatus as claimed in claim 12, wherein the movable device is adapted to linearly progress in a number of discrete steps to the actuation site, the number of discrete steps corresponding to the predetermined number of actuating signals of the tool.

14. An apparatus as claimed in claim 1, wherein the indexer comprises a collet member having a number of fingers and a protrusion provided at the end of each finger.

15. An apparatus as claimed in claim 14, wherein the collet member comprises a tubular member having a bore which is sized such that an object may pass through the tubular member.

16. An apparatus as claimed in claim 15, wherein each finger is movable between a first position in which the protrusion is outside the bore of the tubular member and a second position in which the protrusion is within the bore of the tubular member and contactable by the object.

17. An apparatus as claimed in claim 16, wherein each finger is bendable between the first and second positions.

18. An apparatus as claimed in claim 16, wherein the main bore of each tool defines a plurality of recesses, and wherein the collet member is locatable within the main bore such that the protrusion of one or more fingers is engaged with a recess when the finger is at the first position and not engaged with a recess when the finger is at the second position.

19. An apparatus as claimed in claim 18, wherein the collet member comprises a first set of fingers and a second set of fingers which is longitudinally spaced from the first set, and wherein the collet member and the recesses are configured such that, when the fingers of the first set are engaged with a recess, the fingers of the second set are not engaged with a recess.

20. An apparatus as claimed in claim 18, wherein the collet member is adapted such that an object passing through the main bore contacts the protrusion of one or more fingers which are at the second position such that the collet member is linearly moved in the direct of travel of the object until the protrusion engages with the next recess.

21. An apparatus as claimed in claim 20, wherein the collet member is adapted such that the linear movement of the collet member causes the protrusion of one or more fingers which are at the first position to disengage from the recess and move to the second position.

22. An apparatus as claimed in claim 18, wherein the collet member is located within the main bore of the tool at a predetermined number of recesses from the actuatable member, the predetermined number of recesses corresponding to the predetermined number of actuating signals.

23. An apparatus as claimed in claim 1, wherein each tool includes one or more fluid ports.

24. An apparatus as claimed in claim 23, wherein the actuatable member includes one or more apertures which are longitudinally spaced from the one or more fluid ports when the actuatable members is connected to the main bore.

25. An apparatus as claimed in claim 23, wherein the indexer is adapted to contact and act upon the actuatable member to move the actuatable member and cause the one or more fluid ports to become opened.

26. An apparatus as claimed in claim 1, wherein the actuatable member includes at least one connecting member for connecting the actuatable member to the main bore.

27. An apparatus as claimed in claim 1, wherein the indexer comprises a first collet member, and each tool includes a second collet member provided downstream of the actuatable member, and wherein the apparatus is adapted such that movement of the actuatable member causes the second collet member to disengage a recess such that an object is stopped by the second collet member.

28. The apparatus of claim 1, wherein the plurality of downhole tools are arrangable within and along a tubular positioned within a wellbore, and the main bore of each tool defines a diameter substantially equal to the diameter of a bore through the tubular.

29. The apparatus of claim 1, wherein the actuatable member comprises a sleeve.

30. A method for sequentially actuating a plurality of downhole tools which are arranged within and along a well bore, the method comprising the steps of:

providing an actuatable member at each tool;

providing an indexer within a main bore of each tool, wherein each indexer is configured to register receipt of a predetermined number of actuation signals to linearly progress in a corresponding number of discrete steps along the main bore towards the actuatable member to contact and act upon the actuatable member and cause actuation of the tool;

configuring at least two of the tools to be actuated when a different predetermined number of actuating signals has been received; and sending a number of actuating signals to the plurality of tools, the number being at least equal to the highest predetermined number of actuating signals.

31. A method as claimed in claim 30, wherein each tool defines a main bore having a diameter substantially equal to the diameter of the bore through a tubular positioned within the well bore, and each tool is actuatable to open one or more fluid ports which are transverse to the main bore.

32. A method as claimed in claim 30, including increasing the predetermined number of actuating signals of each tool from the tool furthest from the surface to the tool nearest the surface.

33. A method as claimed claim 30, including adapting the indexer to register the presence of at least one object transported within the associated tool, which thus provides the actuating signal.

34. A method as claimed in claim 33, including adapting the indexer to register the presence of a plurality of objects transported therethrough, each object being substantially the same size.

35. A method as claimed in claim 33, including, when the predetermined number of actuating signals has been received, causing the object to stop at the tool.

36. The method of claim 33, including, when the predetermined number of actuating signals has been received, causing the object to stop at the tool to block the main bore of the tool.

37. A method as claimed in claim 30, including linearly moving a movable device towards an actuation site in response to receiving an actuating signal whereupon the device causes actuation of the tool.

38. A method as claimed in claim 33, including moving the movable device in a number of discrete steps to the actuation site, the number of discrete steps corresponding to the predetermined number of actuating signals of the tool.

39. A downhole actuating system comprising:

a plurality of downhole tools arrangable within and along a well bore, each tool defining a main bore;

an actuatable member provided at each tool;

an indexer provided within the main bore of each tool and adapted to register receipt of a plurality of actuating signals to linearly progress in a corresponding number of discrete steps along the main bore towards the actuatable member to contact and act upon the actuatable member and cause actuation of the tool when a predetermined number of actuating signals has been received, wherein the indexer of at least two of the tools is adapted to cause actuation when a different predetermined number of actuating signals has been received such that the downhole tools are sequentially actuatable; and a plurality of objects adapted to be transported through the tools, and each of said plurality of objects provides the actuating signal.

40. The system of claim 39 wherein said plurality of objects comprise a plurality of balls which have substantially the same size.

41. A downhole tool, comprising:

a housing defining a main bore;

an actuatable member moveable from a first configuration to a second configuration to permit actuation of the tool; and an indexer mounted within the housing on one axial side of the actuatable member and arranged to progress linearly along the main bore of the housing towards the actuatable member in a predetermined number of discrete steps of linear movement by passage of a corresponding number of objects through the indexer to contact the actuatable member and cause said actuatable member to move towards its second configuration;

wherein each discrete step of linear movement is caused by impact of a passing object against the indexer in the direction of said movement.

42. The tool of claim 41, wherein the indexer is arranged such that a final discrete step of linear movement of the indexer causes said actuatable member to move towards its second configuration.

43. The tool of claim 41, wherein the tool further comprises a seat located on an opposite axial side of the actuatable member to catch an object which has passed through the indexer.

44. The downhole tool of claim 41, wherein the housing comprises a fluid port in a wall thereof.

45. The downhole tool of claim 44, wherein the actuatable member is configured to cause the fluid port to become opened when said actuatable member is moved towards its second configuration.

46. A method for fracturing a well, comprising:

arranging a fracturing tool within a wellbore;

delivering a number of objects through an indexer mounted within a main bore of the tool to linearly progress the indexer along said main bore in a corresponding number of discrete steps of linear movement towards an actuatable member located on one axial side of the indexer, such that the indexer is brought into contact with and acts upon the actuatable member to cause said member to move and permit opening of a fluid port; and flowing a fracturing fluid through the opened fluid port.

47. A method as claimed in claim 46, further comprising:

delivering an object through the indexer to linearly move the indexer one discrete step along the main bore; and delivering at least one further object through the indexer to linearly move the indexer one further discrete step along the main bore to cause the actuatable member to move and permit opening of the fluid port.

48. A method as claimed in claim 46, further comprising impacting an object against the indexer to move said indexer a discrete step along the main bore.

49. A method as claimed in claim 46, further comprising blocking the main bore to divert flow from the main bore through the opened fluid port.

50. A method as claimed in claim 49, comprising blocking the main bore at a location on a side of the actuatable member opposite to that of the indexer.

51. A method as claimed in claim 49, comprising blocking the main bore with an object which has actuated the indexer to move by a discrete step.

52. A method as claimed in claim 49, comprising blocking the main bore with an object which has actuated a final discrete step of the indexer.

53. A wellbore system, comprising:

a tubing string extending along a wellbore;

first and second tools arranged along the tubing string, wherein each tool includes:

a housing defining a main bore in communication with the tubing string;

an actuatable member moveable from a first configuration to a second configuration to permit actuation of the associated tool; and an indexer mounted within the housing on one axial side of the actuatable member and arranged to progress linearly along the main bore of the housing towards the actuatable member in a predetermined number of discrete steps of linear movement by passage of a corresponding number of objects through the indexer to contact the actuatable member and cause said actuatable member to move towards its second configuration, wherein the indexer of the first and second tools are arranged to actuate the respective actuatable members upon passage of a different number of objects.

54. The system of claim 53, wherein the first tool is located downhole of the second tool, and the first tool is arranged to receive an object which has passed through the second tool such that said object actuates a discrete linear step of the indexer of each tool.

55. The system of claim 53, wherein the first tool is located downhole of the second tool, and the indexer of the first tool is arranged to move the associated sleeve of the first tool upon passage of a lower number of objects than the indexer of the second tool.

56. The system of claim 53, wherein the housing of each tool includes a fluid port, and the actuatable member is moveable towards its second configuration to permit said fluid port to be opened.

* * * * *